US005161505A

United States Patent [19]

Bederna et al.

[11] Patent Number: 5,161,505

[45] Date of Patent: Nov. 10, 1992

[54] METHOD AND ARRANGEMENT FOR DETECTING MEASURED VALUES IN MOTOR VEHICLES

[75] Inventors: Frank Bederna, Markgröningen; Bernd Lieberoth-Leden, Leonberg, both of Fed. Rep. of Germany

[73] Assignee: Robert Bosch GmbH, Stuttgart, Fed. Rep. of Germany

[21] Appl. No.: 812,952

[22] Filed: Dec. 23, 1991

[30] Foreign Application Priority Data

Dec. 22, 1990 [DE] Fed. Rep. of Germany ..... 4041505

[51] Int. Cl.[5] ..... F02D 45/00

[52] U.S. Cl. ..... 123/399; 123/198 DC

[58] Field of Search ..... 123/399, 198 DC, 198 DB

[56] References Cited

U.S. PATENT DOCUMENTS 4,622,936 11/1986 Junginger et al. ..... 123/399
4,660,520 4/1987 Inoue et al. ..... 123/399
4,849,896 7/1989 Bürk et al. ..... 123/399

FOREIGN PATENT DOCUMENTS 3327376 2/1985 Fed. Rep. of Germany .
90/11442 10/1990 World Int. Prop. O. .

*Primary Examiner*—Andrew M. Dolinar
*Attorney, Agent, or Firm*—Walter Ottesen

[57] ABSTRACT

The invention is directed to a method and an arrangement for detecting measured values in combination with an engine control system for motor vehicles. The position of an adjusting device is determined on the basis of stored extreme values of this position and the detected positioning signal. The stored extreme values are corrected or learned anew at the end of an operating cycle of the motor vehicle after the engine is switched off.

11 Claims, 5 Drawing Sheets

METHOD AND ARRANGEMENT FOR DETECTING MEASURED VALUES IN MOTOR VEHICLES

FIELD OF THE INVENTION

The invention relates to a method and an arrangement for detecting measured values in combination with an engine control system in motor vehicles.

BACKGROUND OF THE INVENTION

A method and arrangement of the kind referred to above is disclosed in U.S. patent application serial No. 761,989, filed on Sep. 25, 1991. In this application, the measured value for the position of an adjusting device of the motor vehicle and/or of the internal combustion engine is determined on the basis of stored end values representing the end position of the adjusting devices and on the basis of the measuring signal of a position transducer which is connected to the adjusting device. To determine the precise position of the end position, the adjusting device is driven in the direction of the lower end position in the prestart phase of the engine in advance of the starting procedure when the ignition key is turned. The measured position of the adjusting device is stored as the end value representing the end position when the control variable of the adjusting device assumes a pregiven limit value for a pregiven time duration or when this control value exceeds the limit value. Thereafter, the adjusting device is driven into its upper end position, that is its maximum position, and the measured value of the position transducer is stored as representing the end position when the control variable of the adjusting device assumes a limit value for a pregiven time or exceeds this limit value. Alternatively, the learning process takes place with reference to the upper end position (the maximum position) when, during driving operation, the adjusting device is in the vicinity of its upper end position; stated otherwise, when the adjusting device is in a pregiven region about the upper end position or the stored end value representing this end position.

Carrying out the learning process by closing the ignition switch (at the beginning of an operating cycle) deteriorates the starting performance of the engine since the time needed for the learning process should be ahead of the starting procedure of the engine. Furthermore, the danger exists of a deterioration of the exhaust gas since the measures for determining the fuel quantity to be measured can be influenced negatively by the changes of the position of the adjusting device in advance of the start phase of the engine.

SUMMARY OF THE INVENTION

It is therefore an object of the invention to provide measures which carry out the detection of a position measurement value of an adjusting device without influencing the operating performance of the engine. This is achieved in that the detection of the extreme value at the termination of an operating cycle of the motor vehicle is undertaken after switching off the engine.

Published German patent application 33 27 376 discloses measures which, for a pregiven time, maintain the function of the control system for the adjustment of an electrically actuable adjusting device after switching off the engine.

The procedure of the invention ensures the precise detection of the end positions or of an end position of a power-determining adjusting device of an internal combustion engine especially a throttle flap or a control rod of an injection pump.

The learning process is undertaken at the end of the operating cycle of a motor vehicle following the switch-off of the engine. In this way, the negative effects of the learning process on the starting performance of the engine and on the exhaust-gas composition in the start phase are effectively prevented.

Furthermore, the procedure provided by the invention for determining or correcting an extreme value of the position of the adjusting device avoids electrical and mechanical damage in the region of the adjusting device by monitoring the change of the control variable and by a slow movement toward the end position of the adjusting device.

The procedure provided by the invention also makes it possible to determine the extreme values of the position of an adjusting device immediately, for example, when building in a new engine control system or a new position transducer or after the motor vehicle is produced. Positioning and adjustment work is not required.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
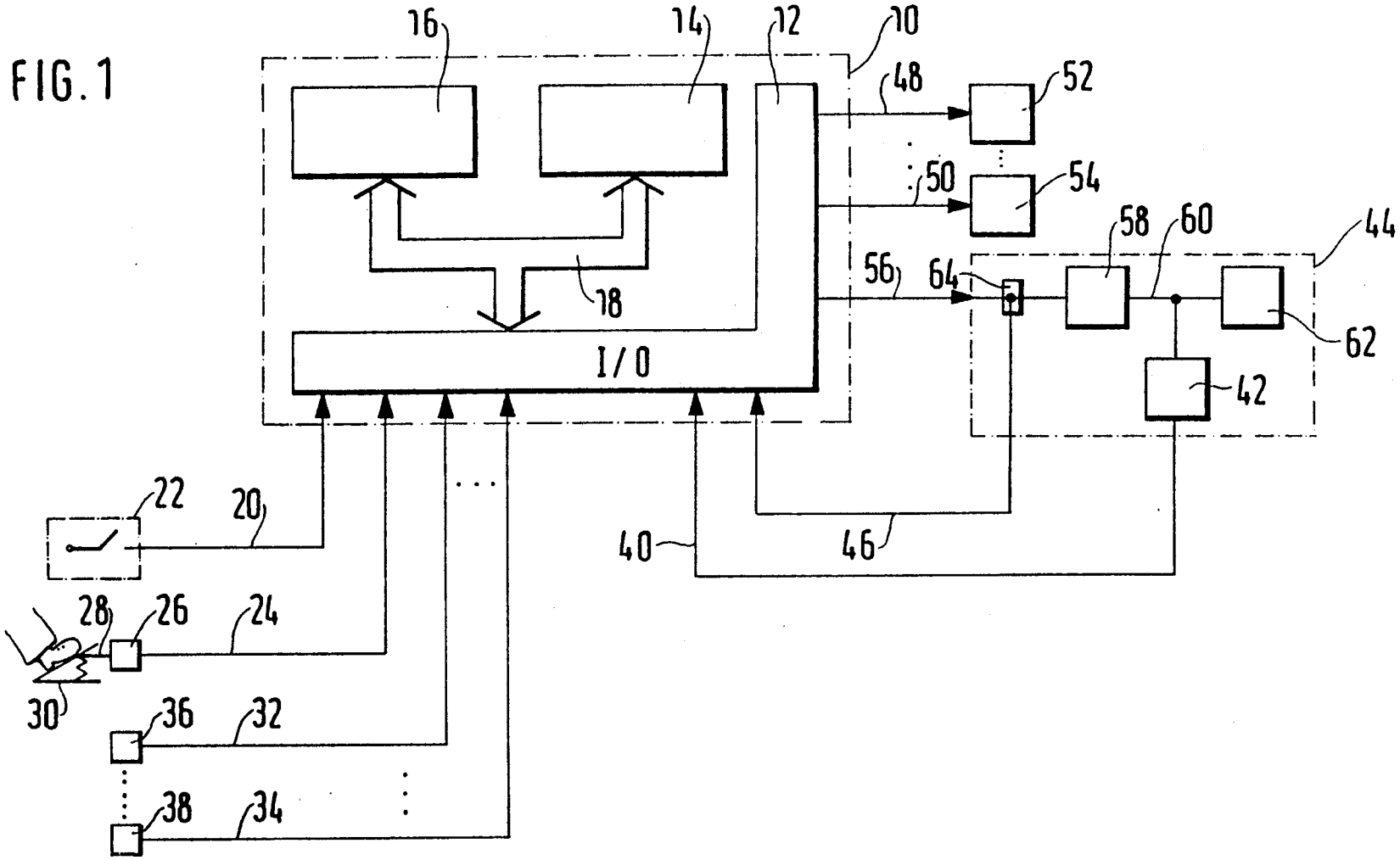
FIG. 1 is a block diagram of an engine control system incorporating the arrangement of the invention for detecting measured values.

FIG. 1 shows an engine open-loop control system 10 which includes an input/output unit 12, a memory unit 14 and a computing unit 16. A line or bus system 18 constitutes a part of the engine control system 10 and interconnects input/output unit 12, memory unit 14 and computer unit 16 and ensures communication between these three units.

The following input lines are connected to the engine control system 10 or, more specifically, the input/output unit 12: the line 20 from an ignition switch 22, the line 24 from a position transducer 26, the lines 32 to 34 from measuring units 36 to 38 for detecting operating variables of the engine or vehicle; the line 40 from a position transducer 42 which detects the position of the adjusting device 44 influencing the power of the engine; and, the line 46 which conducts a measurement signal for the control variable of the adjusting device 44. The position transducer 26 is connected via a rigid connection 28 to an operator-controlled element such as an accelerator pedal 30 actuable by the driver.

The engine control system 10 or, more specifically, the input/output unit 12 includes output lines 48 to 50 which are connected to positioning elements 52 to 54 for influencing further operating variables of the engine and/or of the vehicle or for carrying out further functions such as adjusting the ignition time point, fuel metering, transmission control, etc.

Also, an output line 56 is provided which connects the engine control system 10 or the input/output unit 12 to the adjusting device 44. The adjusting device includes a positioning motor 58 which is connected via a rigid connection 60 to the actuated element 62 which influences the power of the engine. The position transducer 42 detects the position of the adjusting device 44 and is integrated therein. The position transducer detects the position of the positioning motor 58, of the rigid connection 60 as well as the position of the actuated element 62. The control current applied via output line 56 to the adjusting device is detected by the measuring unit 64 and is fed back via the line 46 to the engine control system 10.

In the embodiment of FIG. 1, the measuring unit 64 is shown next to the positioning motor 58 for detecting the current flowing in the positioning motor. The measuring unit is realized in this case by a measuring resistor, for example, which can also be mounted in the region of the input/output unit 12 especially in the region of the output stage of the engine control system 10. A further advantageous embodiment for measuring the control variable is to use, in lieu of the control current, a measurement signal which is derived from another control variable for the adjusting device. The output variable of the position controller, the magnitude of the drive signal, its pulse duty factor or a characteristic voltage variable of the drive signal can advantageously be applied as a measure for the magnitude of the control variable.

The engine control system 10 carries out several functions for controlling the engine or motor vehicle in dependence upon its input variables. In connection with the adjusting device 44, only the control thereof is of interest. This control includes a position controller of the adjusting device for controlling the power of the engine in dependence upon the input variables. A desired value for the position of the adjusting device is formed in dependence upon the input variables especially the position of the operator-controlled element determined by the position transducer 26. The engine control system and especially the computer unit 16 carries out a control of the position of the adjusting device via a control unit in dependence upon this desired value and the actual value of the position of the adjusting device which is supplied via line 40. This control via the control unit, which is a component of the computer unit 16, is in the sense of a reduction of the difference between the desired and actual values. Additional influencing variables which influence the formation of the desired value are supplied via the lines 32 to 34. These influencing variables are, for example, battery voltage, road speed, engine speed, engine temperature, drive slip control and engine drag torque control intervention, etc. Furthermore, the engine control system carries out measures for metering fuel, setting the ignition time point, etc. which are of no consequence in connection with the procedure provided by the invention.

The position transducers 26 and 42 can be individual sensors or can be double or triple sensors. They can operate on the basis of the potentiometric principle as well as contactless sensors.

Figure 2:
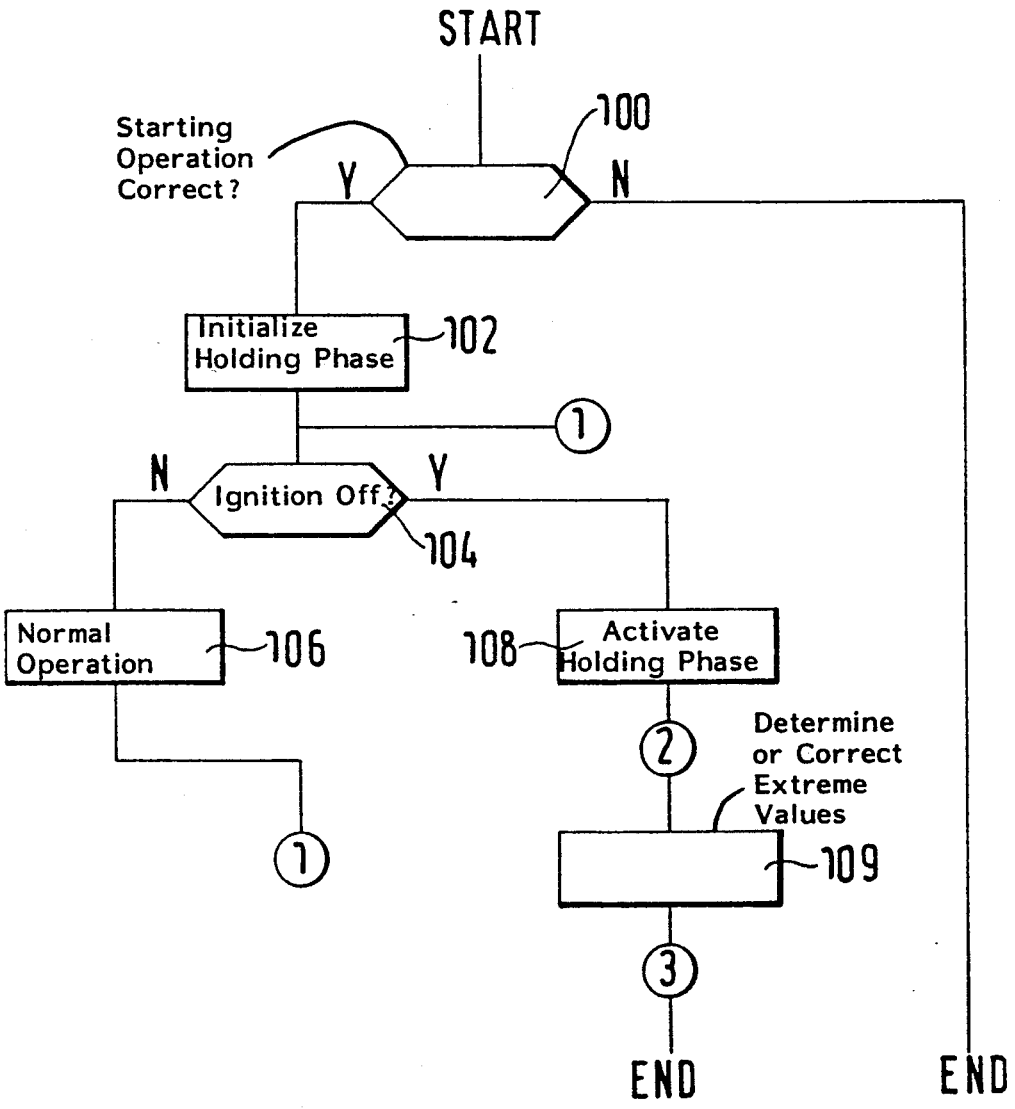
FIG. 2 is a flowchart showing the basic structure of the program for the learning procedure according to an embodiment of the invention.
Figure 3A:
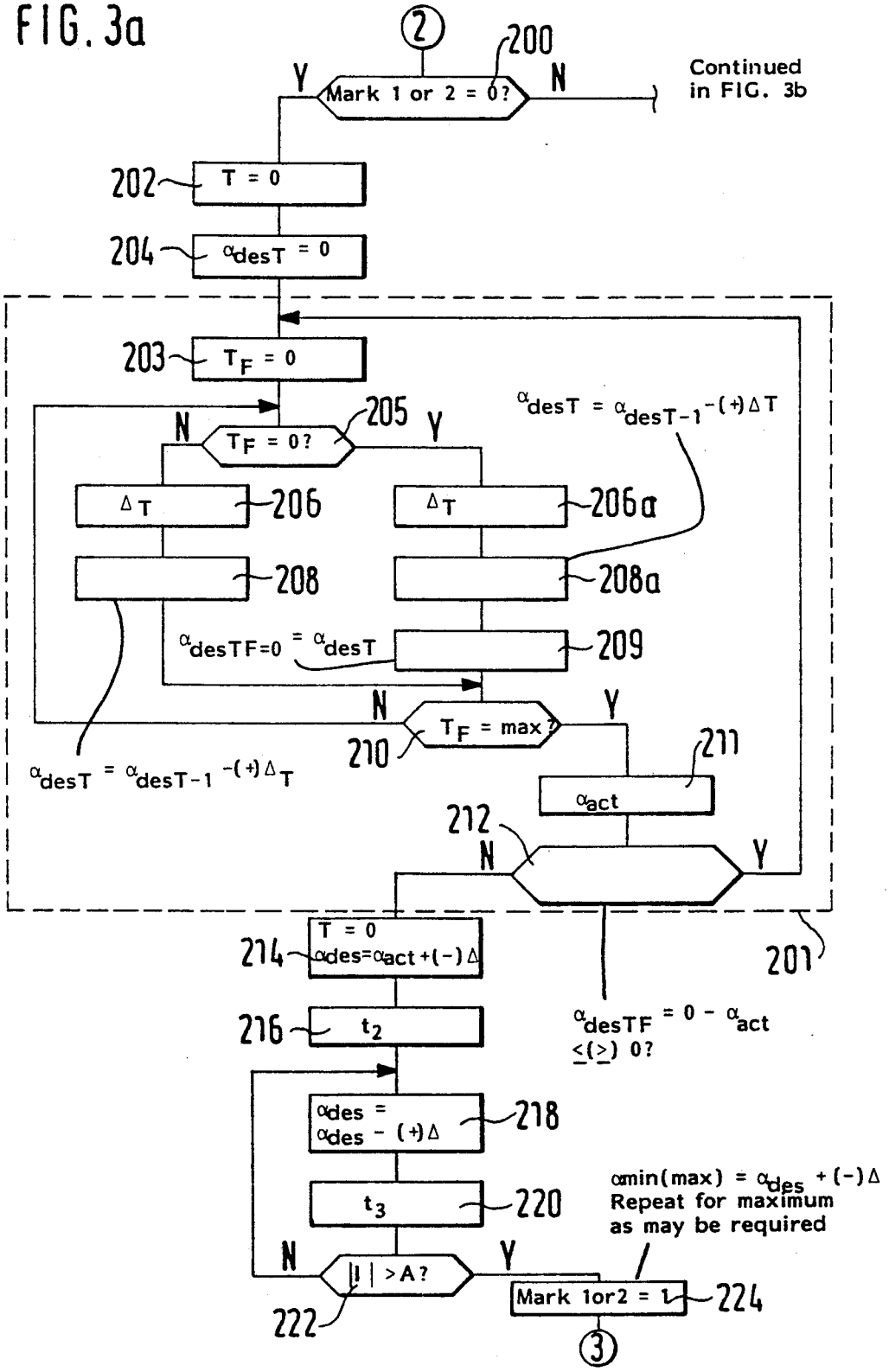
FIGS. 3*a* and 3*b* show the learning procedure for an end position of the adjusting device; and, FIGS. 4*a* and 4*b* show typical signal traces exemplary of the lower or minimum stop of a throttle flap.
Figure 3B:
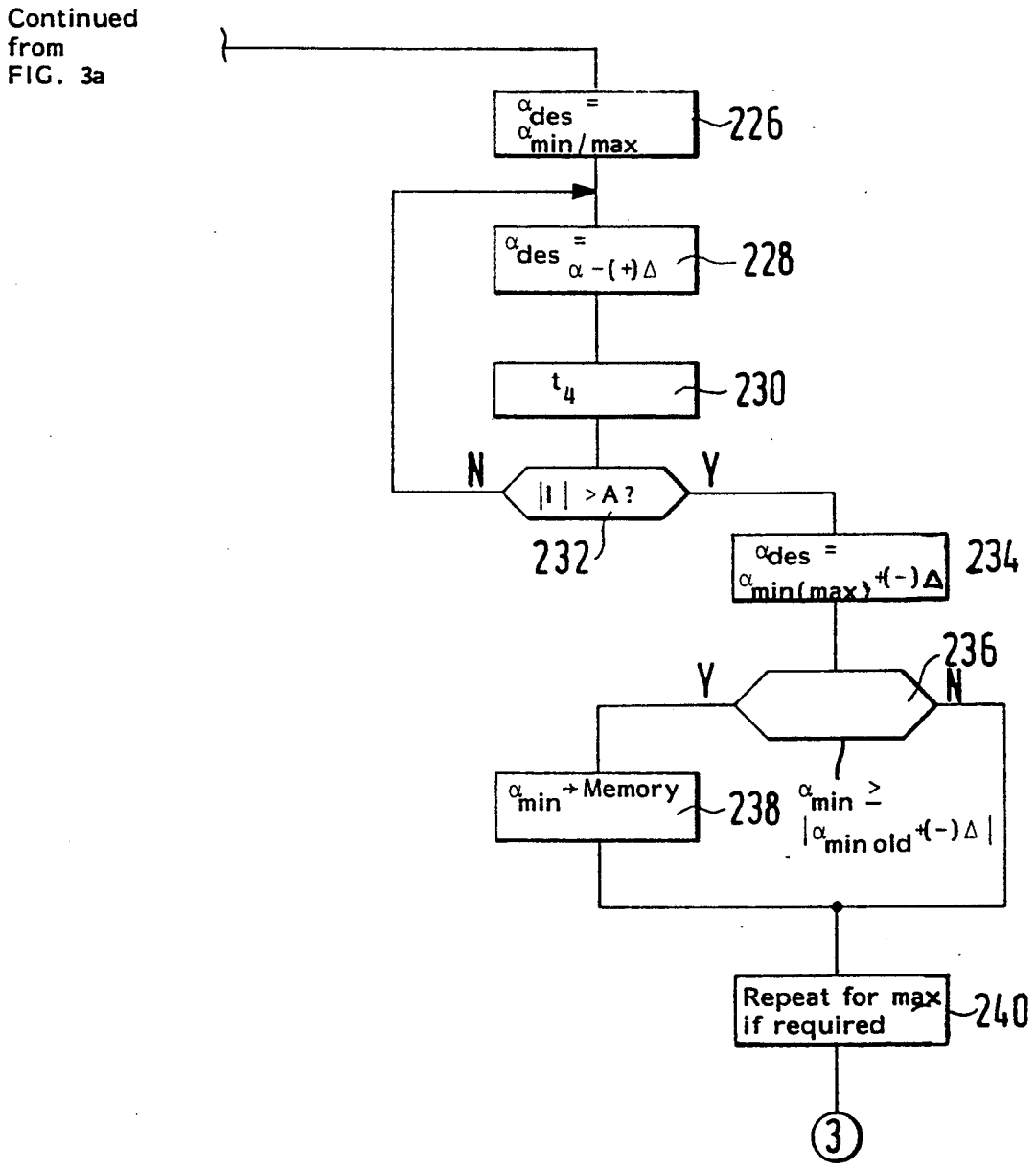

The learning procedure according to the invention is carried out by the engine control system or the computer unit 16 thereof in correspondence with the computer program shown in FIGS. 2 and 3. FIG. 2 shows the basic structure of this program.

After start of the engine, an inquiry is made in inquiry step 100 as to the correct carrying out of the starting procedure. This inquiry includes determining whether the engine speed detected by measuring units 36 to 38 has exceeded a pregiven minimum threshold for the first time. If this is not the case, the program part is ended and is again taken up with a new start of the engine. Detection of start can also take place, for example, on the basis of the output voltage of a generator or of a λ signal. In the opposite case, the correct carrying out of the start phase leads to the initialization of a so-called holding phase in accordance with step 102. In the holding phase, the control possibility of the adjusting arrangement 44 at the end of an operating cycle after switching off the engine and for the switched off ignition is maintained for a pregiven time span in that in one embodiment, the voltage supply of the engine control system is maintained for a specific time T, for example via a type of time circuit which connects the engine control system to the battery of the vehicle and the activation thereof is maintained at the end of the operating cycle in step 102 after a correct start.

Thereafter, in step 104, an inquiry is made as to whether the ignition switch 22 is again opened or if the ignition switch is switched off or the engine has been switched off. If this is not the case, the normal operation of the engine is carried out according to step 106; in the opposite case, the holding phase is initiated according to step 108 and the extreme value or the extreme values of the adjusting device are determined or corrected in correspondence to step 109.

After step 106, the inquiry according to step 104 is repeated in pregiven time intervals if required; whereas, after step 109, the program part is ended.

In normal operation, the position of the adjusting device 44 is determined by interpolation and normalization in a known manner on the basis of the stored end values and on the basis of the actual measurement signal detected by the position transducer 42.

The procedure provided by the invention for determining the end values in accordance with step 109 is shown in greater detail in FIG. 3.

FIG. 3 shows the learning procedure for an end position of the adjusting device. The learning procedure can be applied in an advantageous way for the minimum as well as for the maximum end positions of the positioning device and also with multiple sensors which, parallel to each other, detect the position of the adjusting device. In the last case, the position signals of the individual sensors are each treated separately. Upon a determination of the minimum extreme value, the determination of the maximum value can take place with the same program structure or the determination of the corresponding end value of another sensor.

At the beginning of the program part with the holding phase activated in step 108, a mark is checked in step 200 which carries the value zero if the subsequent learning procedure for the particular extreme value is carried out for the first time. If the mark has the value (1), then the learning procedure was carried out at least once for the particular end value of the particular sensor. Mark (1) identifies the minimum extreme value and mark (2) identifies the maximum extreme value.

The measures according to the invention will be first described in connection with a first-time determination of the extreme value. In the following, the particular steps or inquiries for a minimum extreme value are shown while those corresponding to a maximum value are given in parentheses.

In step 202, a first counter T is set to zero. In step 204, the desired value is taken to a value $\alpha_{des1T=0}$ ($\alpha_{des2T=0}$) which lies above (below) the extreme value to be determined considering all tolerances. The desired value is here understood to be the desired value of a position control loop of the adjusting device or a variable directly controlling the adjusting device.

The following steps are included in the program section 201 and in these, the adjusting device is driven in the direction of its end position. This drive takes place under the continuous check as to whether the measured position value or the actual value of the adjusting device follow the changed desired value after a pregiven filter time $T_F$. The desired value is then reduced (increased) with the changing velocity reducing with advancing time. These measures are outlined in section 201 by the steps 203 and 205 to 212.

After carrying out step 204, a filter time $T_F$ is set to zero pursuant to step 203 and, in the following step 205, an inquiry is made as to whether the filter time has the value zero.

If this is the case, the method continues with steps 206*a*, 208*a* and 209; otherwise, with steps 206 and 208. The steps 206 and 206*a* as well as 208 and 208*a* are the same in both their content and function.

In step 206 or step 206*a*, a reduction (increase) value $\Delta_T$ is detected by which the desired value in step 208 or 208*a* at time point T is reduced (increased) for the position of the adjusting device starting from the desired value at time T−1 ($\alpha_{desT}$=αdesT−1−(+) $\Delta_T$). The reduction (increase) value then reduces with increasing time duration. In this way, the condition is avoided that the adjusting device is driven with full force against its mechanical stop thereby avoiding possible mechanical and/or electrical damage.

After carrying out step 208*a*, the desired value $\alpha_{desT}$ computed in step 208*a* is stored as desired value $\alpha_{desTF=0}$ at time point $T_F=0$ for the case of step 209 and in an analog manner to step 208, the time variables T and $T_F$ are increased by one.

Inquiry step 210 follows the steps 208 or 209 with the inquiry as to whether the filter time has reached its maximum value. For a negative answer, the steps 205, 206 and 208 are repeated which leads to a further reduction (increase) of the desired value. If the filter time has however elapsed, then the actual value of the position of the adjusting device $\alpha_{act}$ is detected and a check is made in step 212 as to whether the actual value has followed the changed desired value. The desired value stored at time point $T_F=0$ is compared to the actual value as to whether the actual value is less (greater) or equal to this desired value ($_{60}$desTF=0<=(>=)$\alpha_{act}$). If this is the case, then the actual value follows the desired value and the steps 203 to 212 are repeated.

The measures described outline a possibility to control the adjusting device with decreasing velocity in the direction of one of its end positions while continuously checking as to whether the actual value can follow the desired value within a pregiven filter time. In another embodiment, another form of realization of this measure can be selected.

If it is detected in step 212 that the actual value no longer can follow the desired value within a filter time, then the method proceeds from a control of the adjusting device against one of its end positions and the time T is reset to zero with step 214 and the last measured actual value, increased (reduced) by a Δ value as a clearance distance, is preset as a new desired value.

After the filter time T2 has run according to step 216, this new desired value is reduced (increased) in step 218 by a reduction (increase) amount α1 (α2).

After a third filter time T3 has run which follows step 218 in step 220, the control variable of the adjusting device is checked in inquiry step 222 with respect to a limit value. If the increase of the control variable does not exceed a pregiven permitted limit value A after the filter time T3 has run, then the presumption is made that the mechanical stop of the adjusting device has not been reached and the program part of steps 218 to 222 is again run through.

If the control variable of the adjusting device reaches the pregiven permitted limit value A after the time T3 has elapsed, then it is assumed that the mechanical stop has been reached and, in step 224, the mark 1 (2) introduced initially with respect to step 200 is set to 1. The learning process of the lower (upper) extreme value is then concluded and a value $\alpha_{min}$ ($\alpha_{max}$) is supplied to the memory which value is formed from the desired value present in step 224 and increased (reduced) by a pregiven Δ amount for safety reasons. Thereafter, the program part is carried out for the upper stop; otherwise, the program part is ended.

If the determination is made in inquiry step 200 that the mark has the value 1, that is, that a learning process has already taken place, the method continues with step 226 for correcting the extreme value and the desired value for the position of the adjusting device is set to the stored minimum value (maximum value). Starting from this desired value, measures are taken in steps 228 to 234 to determine the extreme value which correspond to the measures taken in steps 218 to 224 with the setting of the marks in step 224 not being necessary. The steps 228 to 234 are therefore not described in detail in the following and correspond with respect to their function to the particular corresponding step in the steps 218 to 224. In this connection, it is noted that the individual parameters α1 (α2), T4, the limit value with the check of the control variable as well as the Δ amount according to step 224 can be selected differently in steps 228, 230, 232 and 234.

The check of the increase of the control variable of the adjusting device with a pregiven threshold value permits an early precise detection of a drive of the adjusting device against a mechanical stop and contributes advantageously to preventing damage of a mechanical or electrical nature.

At the conclusion of the learning operation, a check is made in step 236 which follows step 234 as to whether the newly learned extreme value deviates from the old stored extreme value by a pregiven tolerance amount. If this is not the case, the old stored value is retained and the program part is ended and possibly repeated starting with step 226 for the maximum value. If the newly detected extreme value deviates from the old stored extreme value by a pregiven tolerance amount, then in step 238, the newly learned extreme value is inputted into the memory and thereafter the program part is ended or possibly repeated for the particular other end value starting with step 226.

Figures 4A, 4B:
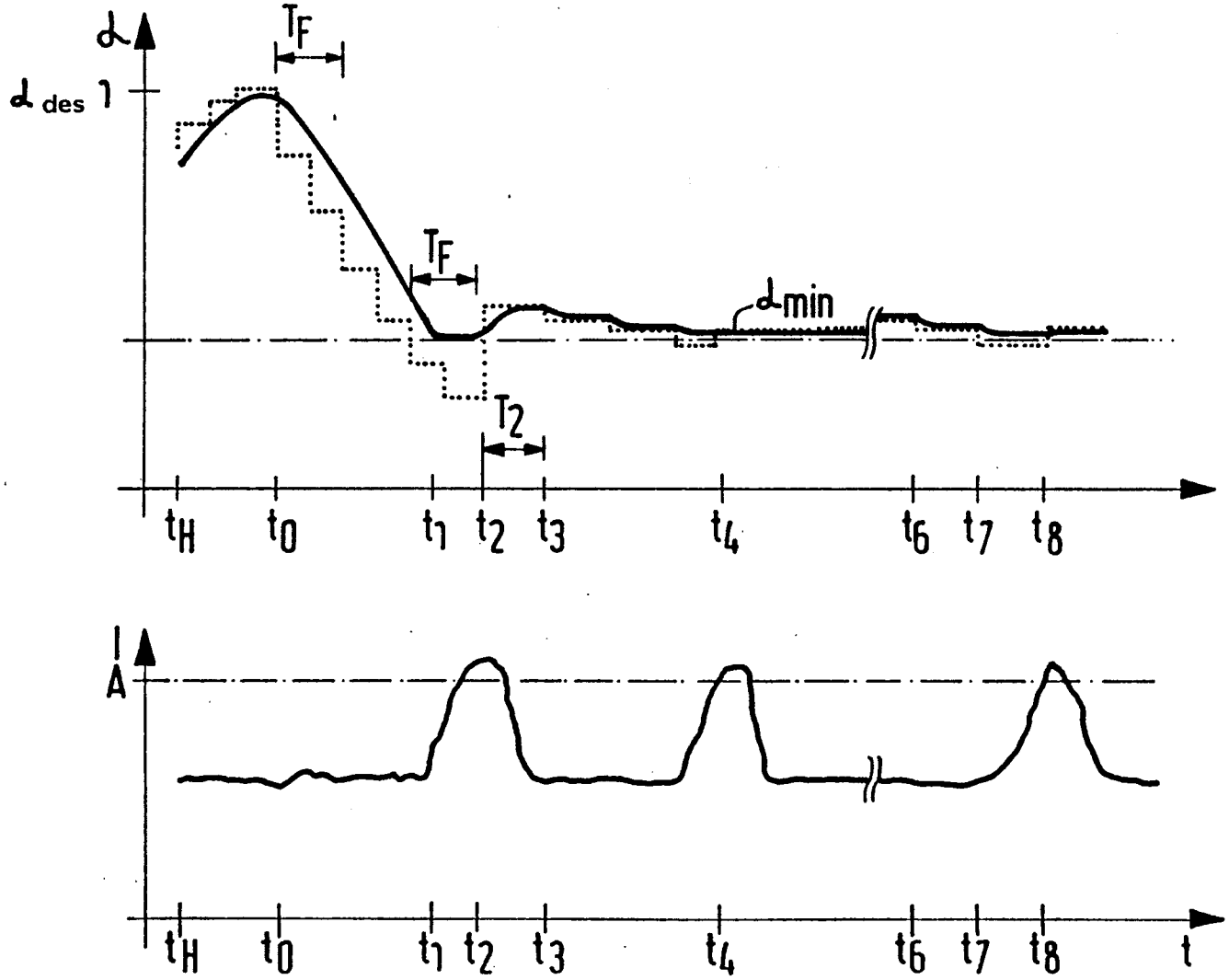

The time-dependent signal traces of the corresponding signals, when carrying out the procedure according to the invention described with respect to FIGS. 2 and 3, are shown in FIGS. 4*a* and 4*b*.

FIG. 4*a* shows a time diagram of the actual value of the adjusting device (solid line) as well as the time trace of the pregiven desired value (broken line); whereas, the dash-dot line shows the position of the mechanical minimum stop of the adjusting device. The time t is plotted along the horizontal axis while the position $\alpha$ of the adjusting device is plotted along the vertical axis.

FIG. 4*b* shows a time diagram of the control variable such as the actuator current or the signals mentioned above having the same significance. The time t is plotted along the horizontal axis and a measure I for the magnitude of the control variable is plotted along the vertical axis.

For the first-time learning of the minimum value, the throttle flap is guided to the pregiven value $\alpha_{des1}$ (time point $t_0$) by a corresponding control of the desired value after activating the holding phase by switching off the ignition at time point $t_H$. Thereafter, and according to FIG. 3, the desired value is reduced and the adjusting device is displaced in the direction of its minimal value. This displacement is carried out more slowly with increasing time.

At time point $t_1$, the actual position of the adjusting device reaches the mechanical stop, that is, the actual position is no longer reduced and can no longer follow the desired value. This is determined after the filter time $T_F$ has run to time point $t_2$. The desired value is set to a value formed on the basis of the last measured actual value in a jump-like or delayed manner. The actual value of the adjusting arrangement follows this desired value change and the desired value is reduced by a pregiven value $\alpha_1$ after a filter time T2 has run (time point $t_3$).

The reduction of the desired value, which the actual value follows, is repeated as long as it is detected that the mechanical stop is reached with respect to an increase of the control variable (time point $t_4$). This measure is based on the realization that reaching the mechanical stop can be determined more precisely by checking the increase of the control variable than by monitoring the difference between the desired and actual values. This measure checks if the control variable reaches or exceeds a pregiven limit value within the time T2 and if the control variable continues to exceed this value until the time T2 has run or if the control variable exceeds the pregiven limit value after the time T2 has elapsed.

After it has been determined at time point $t_4$ that an increase of the control variable has taken place, the desired value is increased by a $\Delta$ amount which ensures a clearance spacing from the mechanical stop. The desired value then present is stored as the minimum value. The control variable returns to normal values.

If the minimum value had already been determined for the first time, then the learning procedure is begun with the stored minimum value (time point $t_6$). This minimum value is reduced by a pregiven amount after the filter time T4 (time point $t_7$). If an increase in the control variable as explained above is detected (for example at time point $t_8$), then the desired value is increased by a $\Delta$ amount and the desired value then present is stored as representing the minimum value if the minimum value deviates by a pregiven amount from the previously stored value.

In summary, it can be concluded that at the end of the operating cycle of the motor vehicle a learning process can be carried out after the engine is switched off which reliably permits the extreme values of the position of an adjusting device of an engine to be detected with great accuracy without the operating performance of the engine being negatively influenced.

The learning process proceeds from a first-time learning of a start value of the desired value which is reduced rapidly with time with decreasing velocity in the direction of the extreme value. If the actual value no longer follows the desired value after a filter time, then a second phase of the learning procedure is introduced which ensures a precise detection of the extreme value by the monitoring of the control variable and a slow reduction of the desired value.

At the end of the operating cycle of the motor vehicle, the electrically actuable adjusting device is driven in a pregiven manner against an end position after the engine is switched off for determining at least this end position.

The procedure of the invention described above can be applied in an advantageous manner for determining and correcting extreme values of changeable variables of an engine or a vehicle which are influenced by an adjusting device especially with respect to the extreme values.

It is understood that the foregoing description is that of the preferred embodiments of the invention and that various changes and modifications may be made thereto without departing from the spirit and scope of the invention as defined in the appended claims.

What is claimed is:

1. A method for detecting the measured value of a changing variable in combination with an engine control system, the method comprising the steps of:

providing a measuring signal which defines a measure of the changing variable, said changing variable being limited by at least one extreme value and being influenced by an electrically operable adjusting device;

storing a value representing said extreme value; and, when a pregiven operating condition is present, determining and correcting said value at the end of an operating cycle of the motor vehicle directly after the engine is shut off; and, causing the engine control system to adjust an operating parameter on the basis of the value of the measuring signal and said stored corrected value.

2. The method of claim 1, wherein the changing variable is the position of the electrically actuable adjusting device.

3. The method of claim 1, wherein the extreme value of the changing variable is determined and corrected immediately when the engine control system is taken into service and after each operating cycle is ended.

4. The method of claim 1, wherein the extreme value of the changing variable is determined and corrected immediately when the engine control system is taken into service and after a selected number of operating cycles are ended.

5. The method of claim 1, wherein, for a first-time determination of said extreme value, the adjusting device is influenced in such a manner that said adjusting device is rapidly changed starting from a preadjusted value until the changing variable of the change can no longer follow.

6. The method of claim 1, wherein the adjusting device is influenced in such a manner that the adjusting device slowly reaches the extreme value and the extreme value is deemed as being reached when the control variable of the adjusting device exceeds a pregiven limit value.

7. The method of claim 6, wherein the adjusting device is influenced by changing the desired value controlling the adjusting device and the control variable of the adjusting device being a variable derived from the drive signal.

8. The method of claim 4, wherein the adjusting device can be controlled for a pregiven time after the operating cycle is ended.

9. An arrangement for detecting a measured value of a changing variable in combination with an engine control system, the arrangement comprising:

measuring unit means for generating a measure for the changing variable limited by at least one extreme value;

an electrically actuable adjusting device for influencing said changing variable;

means for determining, correcting and storing said one extreme value; and, means for controlling the adjusting device in the direction of the particular end position starting from a starting position for determining and correcting the extreme value, the adjusting device being controlled at the end of an operating cycle of a motor vehicle directly after the engine is shut off.

10. The arrangement of claim 9, further comprising control means for influencing the adjusting device in such a manner that said adjusting device rapidly reaches said extreme value until the changing variable can no longer follow the signal influencing the adjusting device; said adjusting device being influenced in such a manner that said adjusting device reaches said extreme value slowly starting from stored values and said extreme values being deemed to be reached when the control variable of the adjusting device exceeds a pregiven limit value.

11. The arrangement of claim 9, further comprising means for maintaining the control of the adjusting device for a pregiven time span at the end of an operating cycle.

* * * * *

UNITED STATES PATENT AND TRADEMARK OFFICE

CERTIFICATE OF CORRECTION

PATENT NO. : 5,161,505

DATED : November 10, 1992

INVENTOR(S) : Frank Bederna and Bernd Lieberoth-Leden

It is certified that error appears in the above-identified patent and that said Letters Patent is hereby corrected as shown below:

In column 5, line 54: delete "$(_{60}desTF=0<=(>=)\alpha_{act})$." and substitute -- $\alpha_{desTF=0} <= (>=)\alpha_{act})$. -- therefor.

Signed and Sealed this

Nineteenth Day of October, 1993

*Attest:*

Bruce Lehman

BRUCE LEHMAN

*Attesting Officer*

*Commissioner of Patents and Trademarks*